US005170025A

United States Patent [19]

Perry

[11] Patent Number: 5,170,025

[45] Date of Patent: Dec. 8, 1992

[54] TWO-SIDED SUSCEPTOR STRUCTURE

[75] Inventor: Michael R. Perry, Plymouth, Minn.

[73] Assignee: The Pillsbury Company, Minneapolis, Minn.

[21] Appl. No.: 631,285

[22] Filed: Dec. 20, 1990

[51] Int. Cl.[5] ..... H05B 6/80; B65D 81/34

[52] U.S. Cl. ..... 219/10.55 E; 426/107; 426/234; 426/243; 219/10.55 F

[58] Field of Search ..... 219/10.55 E, 10.55 F; 426/107, 234, 243, 392; 99/DIG. 14; 428/35.7, 348, 349

[56] References Cited

U.S. PATENT DOCUMENTS

| | | | |
|---|---|---|---|
| 4,322,276 | 3/1982 | Meckel et al. | 204/192 P |
| 4,426,275 | 1/1984 | Meckel et al. | 204/298 |
| 4,434,197 | 2/1984 | Petriello et al. | 219/10.55 E |
| 4,518,651 | 5/1985 | Wolfe, Jr. | 219/10.55 E |
| 4,641,005 | 2/1987 | Seiferth | 219/10.55 E |
| 4,666,263 | 5/1987 | Petcavich | 428/687 |
| 4,713,510 | 12/1987 | Quick et al. | 219/10.55 E |
| 4,735,513 | 4/1988 | Watkins et al. | 219/10.55 E |
| 4,848,931 | 7/1989 | Kamada et al. | 219/10.55 E |
| 4,875,597 | 10/1989 | Saunders | 426/107 |
| 4,876,427 | 10/1989 | Mode | 219/10.55 E |
| 4,882,463 | 11/1989 | Kyougoku et al. | 219/10.55 E |
| 4,911,938 | 3/1990 | Fisher et al. | 426/107 |
| 4,916,279 | 4/1990 | Brown et al. | 219/10.55 E |
| 4,925,684 | 5/1990 | Simon | 426/107 |
| 4,933,526 | 6/1990 | Fisher et al. | 219/10.55 M |
| 4,940,867 | 7/1990 | Peleg | 219/10.55 E |
| 4,962,000 | 10/1990 | Emslander et al. | 219/10.55 E |
| 4,970,360 | 11/1990 | Pesheck et al. | 219/10.55 E |
| 4,985,606 | 1/1991 | Faller | 219/10.55 E |
| 5,012,068 | 4/1991 | Anderson | 219/10.55 E |
| 5,017,429 | 5/1991 | Akao | 428/349 |
| 5,021,293 | 4/1991 | Huang et al. | 426/243 |

FOREIGN PATENT DOCUMENTS

| | | |
|---|---|---|
| 0312333 | 10/1988 | European Pat. Off. . |
| 0320293 | 12/1988 | European Pat. Off. . |
| 0320294 | 12/1988 | European Pat. Off. . |
| 0335478 | 1/1989 | European Pat. Off. . |
| 0343006 | 5/1989 | European Pat. Off. . |

OTHER PUBLICATIONS

*Microwave Packaging Symposium,* Sponsored by Rutgers University Center for Packaging Science & Engineering and American Management Association Took place on Apr. 23rd, and 24th, 1990.

*Plastics Which Extend The Performance Of Microwave Packaging,* by F. E. McFarlane and C. M. Stipe, Eastman Chemical Company Kingsport, Tenn.

A group of overheads from a program by Timothy H. Begley and Henry C. Hollifield entitled *Application Of A Teflon Single-Sided Migration Cell For Measuring Migration Through Microwave Susceptor Films.*

*Primary Examiner*—Bruce A. Reynolds
*Assistant Examiner*—Tuan Vinh To
*Attorney, Agent, or Firm*—Kinney & Lange

[57] ABSTRACT

A susceptor structure includes a substrate having a first side and a second side. A first microwave interactive layer is located on the first side of the substrate. A second microwave interactive layer is located on a second side of the substrate. A covering layer is coupled to the first microwave interactive layer. The first microwave interactive layer is coupled to the covering layer more firmly than to the substrate during exposure of the susceptor structure to microwave energy.

53 Claims, 5 Drawing Sheets

Tri-Coordinate Plot of Susceptor R,T,A
In Free Space
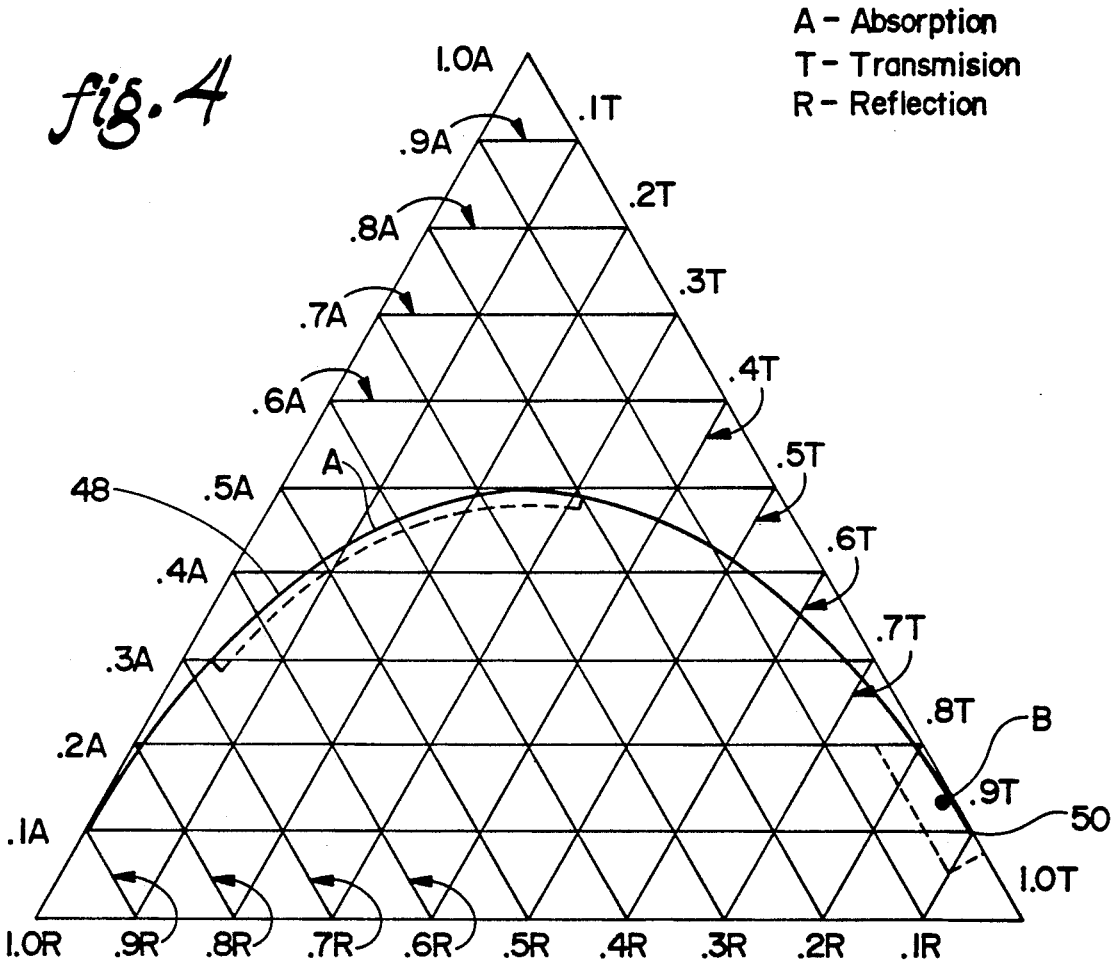

TWO-SIDED SUSCEPTOR STRUCTURE

INCORPORATION BY REFERENCE

The following patents are hereby fully incorporated by reference: a patent entitled FOOD RECEPTACLE FOR MICROWAVE COOKING, U.S. Pat. No. 4,641,005, filed on Jan. 21, 1986, by Seiferth, issued Feb. 1987 and a patent application entitled TEMPERATURE CONTROLLED SUSCEPTOR STRUCTURE, by Michael R. Perry and Ronald R. Lentz, Ser. No. 07/630/867 filed on even date herewith, assigned to the same assignee as the present application.

BACKGROUND OF THE INVENTION

The present invention involves microwave cooking. More particularly, the present invention is a susceptor structure for use in a microwave oven.

Heating of foods in a microwave oven differs significantly from heating of foods in a conventional oven. In a conventional oven, heat energy is applied to the exterior surface of the food and moves inward until the food is cooked. Thus, food cooked conventionally is typically hot on the outer surfaces and warm in the center.

Microwave cooking, on the other hand, involves absorption of microwaves which characteristically penetrate far deeper into the food than does infrared radiation (heat). Also, in microwave cooking, the air temperature in a microwave oven may be relatively low. Therefore, it is not uncommon for food cooked in a microwave oven to be cool on the surfaces and much hotter in the center.

However, in order to make the exterior surfaces of food brown and crisp, the exterior surfaces of the food must be heated to a sufficient degree such that moisture on the exterior surfaces of the food is driven away. Since the exterior surfaces of food cooked in a microwave oven are typically cooler than the interior of the food, it is difficult to brown food and make it crisp in a microwave oven.

In order to facilitate browning and crisping of food in a microwave oven, devices known as susceptors have been developed. Susceptors are devices which, when exposed to microwave energy, become very hot. By placing a susceptor next to a food product in a microwave oven, the surface of the food product exposed to the susceptor is surface-heated by the susceptor. Thus, moisture on the surface of the food is driven away from the surface of the food and the food becomes crisp and brown.

Many conventional susceptor structures have included a thin metal film, typically aluminum, deposited on a substrate such as polyester. The metalized layer of polyester is typically bonded, for support, to a support member such as a sheet of paperboard or corrugated paper.

Conventional susceptors, however, have certain drawbacks. They undergo a process, referred to herein as "breakup," in which the electrical continuity of the thin metal film is lost during cooking. The result of the loss of electrical continuity is an irreversible loss in the susceptor's microwave responsiveness and a lower level of percent power absorption by the susceptor during cooking. Lower power absorption leads to lower susceptor cooking temperatures and a corresponding decrease in the susceptor's ability to crisp food.

As an example of conventional susceptor operation, a frozen food product is placed on a susceptor. The susceptor and the food product are then subjected to microwave energy in a microwave oven. Since the imaginary part of the complex relative dielectric constant of ice is very low, the frozen food product is initially a poor absorber of microwave energy. Therefore, the susceptor is exposed to nearly the full amount of the microwave energy delivered in the microwave oven, heats rapidly and begins to undergo breakup. Meanwhile, the frozen food product absorbs very little energy.

As the frozen food product thaws and starts absorbing microwave energy, the ability of the susceptor to continue to absorb energy, and thereby continue to surface heat the food product, has already been significantly and irreversibly deteriorated by breakup. Since this deterioration (i.e., the change in the electrical continuity of the susceptor) is irreversible, the susceptor is incapable of absorbing enough of the microwave energy attenuated by the thawed food product to properly brown and crisp the food product.

Therefore, there is a continuing need for the development of susceptor structures which are capable of continued heating and crisping of food products during microwave cooking.

SUMMARY OF THE INVENTION

A susceptor structure according to the present invention includes a substrate having a first side and a second side. A first microwave interactive layer is located on the first side of the substrate. A first covering layer is coupled to the first microwave interactive layer. The first microwave interactive layer is more firmly coupled to the first covering layer than to the substrate during exposure of the susceptor structure to microwave energy. Thus, the first microwave interactive layer provides sustained heating.

In one embodiment, a non-shrinking layer is coupled between the substrate and the first microwave interactive layer. The non-shrinking layer effectively releases the first microwave interactive layer from being rigidly coupled to the substrate when the susceptor structure is exposed to microwave energy. This facilitates relative movement of the substrate with respect to the first microwave interactive layer. This reduces the effect that substrate movement has on the first microwave interactive heating layer during exposure to microwave energy and thus reduces or prevents breakup in the first microwave interactive heating layer.

BRIEF DESCRIPTION OF THE DRAWINGS

FIG. 4 is a tri-coordinate plot of susceptor reflection, transmission and absorption in free space.

DETAILED DESCRIPTION OF THE PREFERRED EMBODIMENTS

Figure 1A:
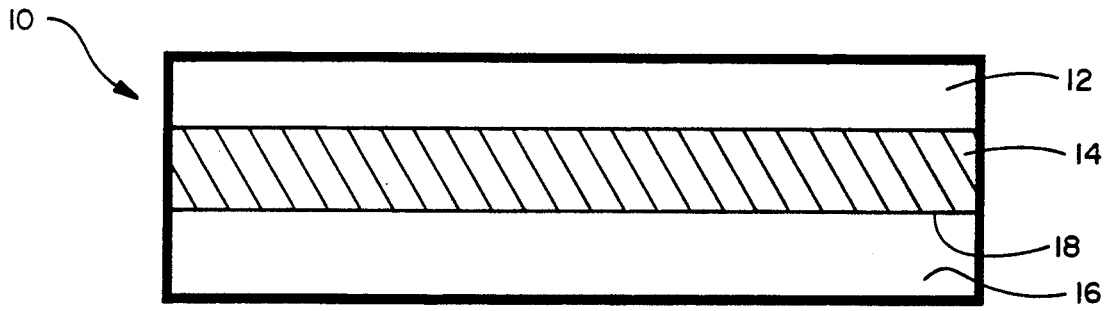
Fig. 1a (PRIOR ART)
FIG. 1A is a side view of a conventional susceptor structure of the prior art.

FIG. 1A shows the relative position of components of a susceptor structure 10 (susceptor 10) of the prior art. It should be noted that susceptor 10 is not drawn to scale in FIG. 1A. For clarity's sake, the thicknesses of layers shown in FIG. IA are greatly exaggerated.

Susceptor 10 includes substrate 12 upon which metalized layer 14 is deposited. Susceptor 10 also includes a support layer 16. Substrate 12 is typically a thin layer of oriented and heat set polyethylene terephthalate (PET). Metalized film 14, in this preferred embodiment, is an aluminum layer deposited on substrate 12 through vacuum evaporation, sputtering, or another suitable method. Support layer 16, typically paperboard or corrugated paper, is coupled to metalized layer 14 at interface 18 through the use of an adhesive.

Figure 1B:
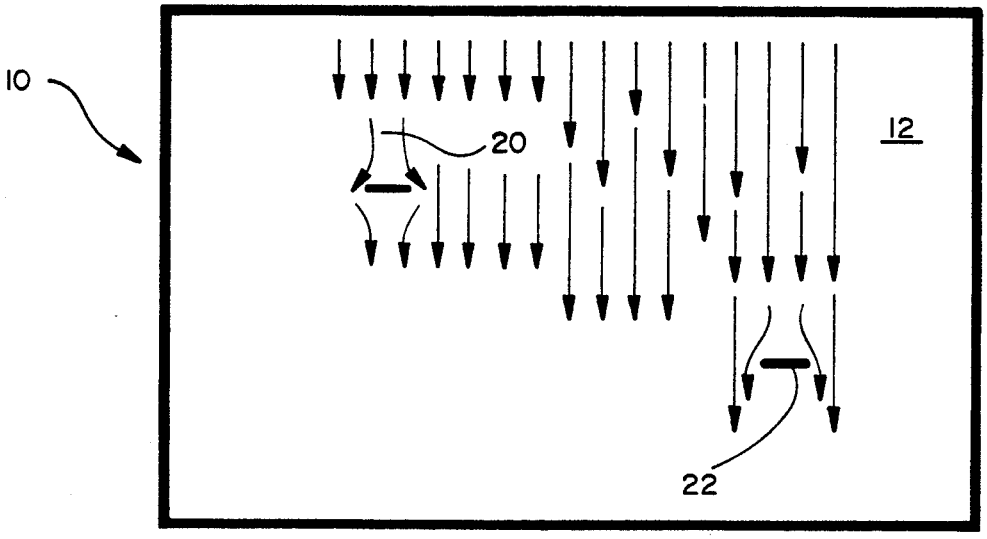
Fig. 1b (PRIOR ART)
FIG. 1B is a top view of the susceptor structure shown in FIG. 1A showing the development of hot spots.

When susceptor 10 is placed in a microwave oven and exposed to microwave energy, current begins to flow in metalized layer 14 of susceptor 10 due to an electric field generated by the microwave oven. A portion of the current flowing in metalized layer 14 is indicated by the vertical arrows shown in FIG. 1B. As the current flows, metalized layer 14 begins to heat as a function of the current generated and the surface resistance (Rs) of layer 14. However, it has been observed that metalized layer 14 does not heat uniformly. Rather, hot spots such as hot spots 20 and 22 develop as illustrated in FIG. 1B.

As the metalized layer 14 continues to heat, and as hot spots 20 and 22 grow hotter, heat transfers throughout the susceptor 10, and the temperature of substrate 12 also increases. Discontinuities such as thinned areas, holes or cracks are formed in metalized layer 14 at the hot spots 20 and 22. It should be noted that, although the temperature of PET substrate, 12 is 220°-260° C. at hot spots 20 and 22 when the discontinuities begin to form in substrate 12 the remainder of substrate 12 is typically much cooler (e.g. 200° C.-220° C. or even lower).

Figure 1C:
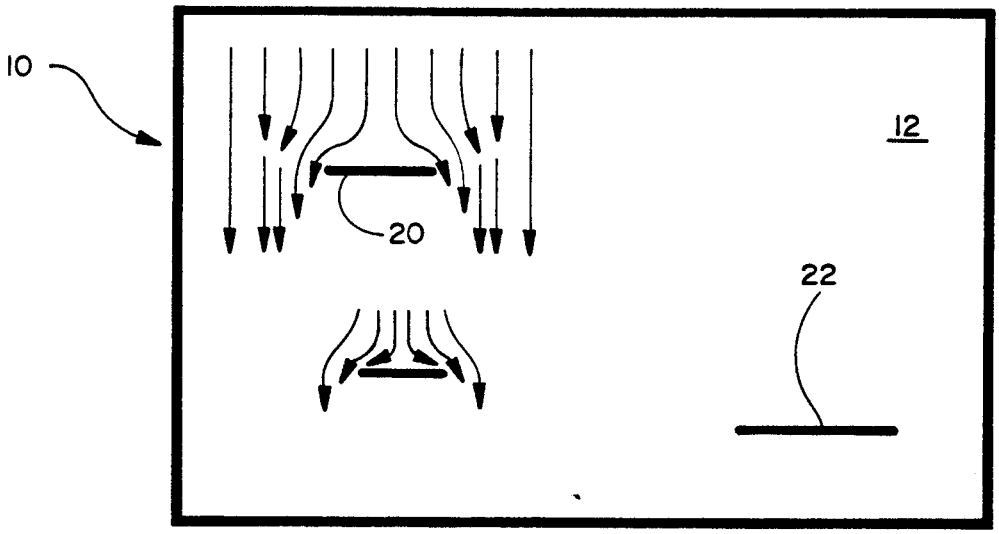
Fig. 1c (PRIOR ART)
FIG. 1C is a top view of the susceptor structure shown in FIGS. 1A and 1B after discontinuities at the hot spots have expanded laterally.

FIG. 1C shows a top view of susceptor 10 after the discontinuities at hot spots 20 and 22 have expanded laterally. As the temperature of susceptor 10 continues to rise, additional lateral cracks form in substrate 12, thereby driving formation of more discontinuities in metalized layer 14. The lateral cracks and discontinuities which form in substrate 12 and metalized layer 14 substantially destroy the electrical continuity in metalized layer 14. This decreases the responsiveness of susceptor 10 to microwave energy, and susceptor 10 begins to cool despite continued exposure to microwave energy. Thus, the ability of susceptor 10 to provide sustained heating is essentially destroyed.

Figure 1D:
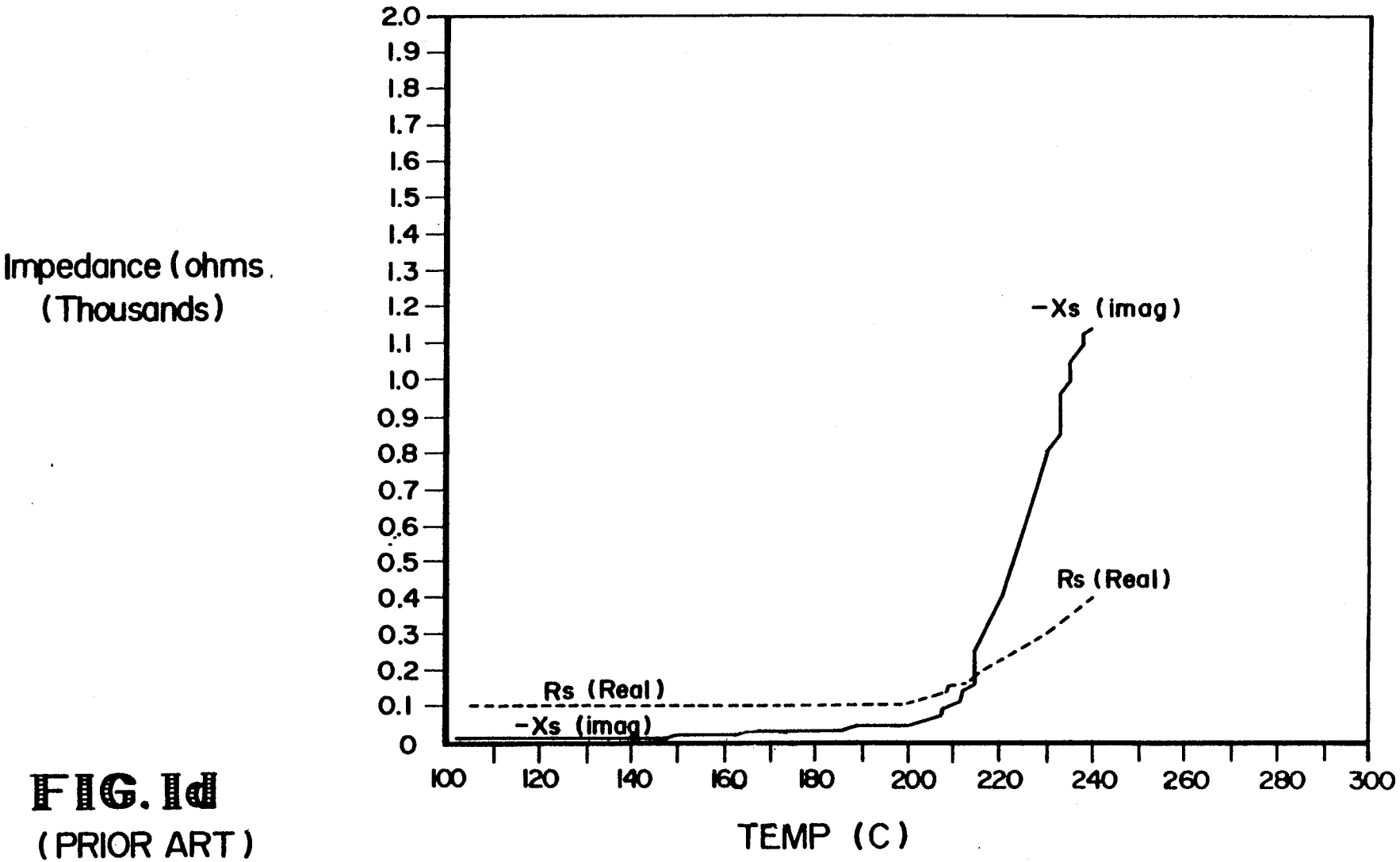
FIG. 1d (PRIOR ART)
FIG. 1D is a graph showing surface impedance of a susceptor plotted against temperature in degrees C.

FIG. 1D shows a graph of the surface impedance (real, $R_s$, and imaginary, $X_s$) of the susceptor 10 plotted against temperature in degrees C. The discontinuities begin to form at approximately 200° C. and continue to form until susceptor 10 essentially stops heating or until heating is reduced.

It should be noted that the electrical field in a typical microwave oven has random direction. Thus, discontinuities generally come in many directions in metalized layer 14 and follow hot spot locations.

Figure 2:
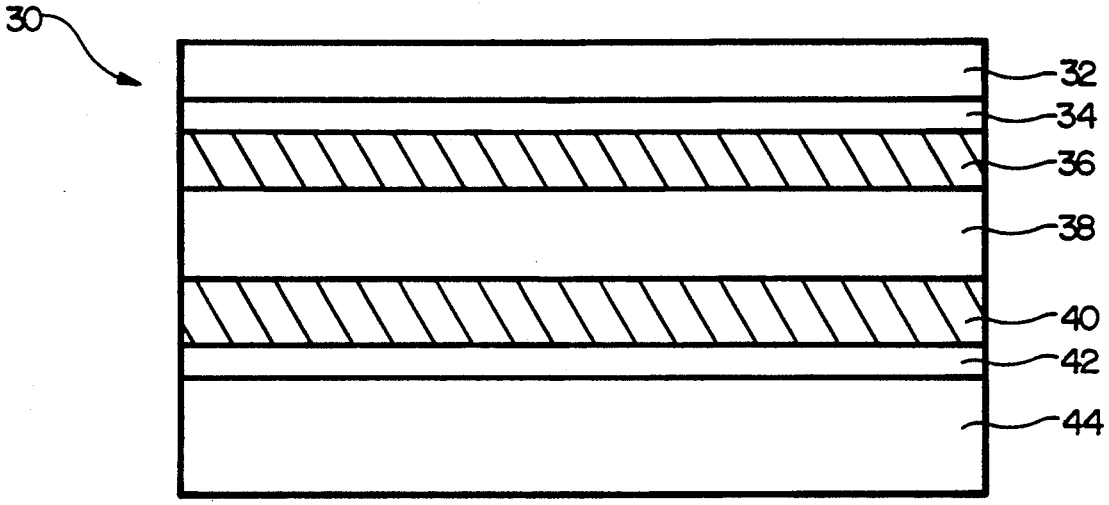
FIG. 2 is one embodiment of a susceptor structure of the present invention.

FIG. 2 shows a side view of a susceptor structure (susceptor 30) of the present invention. Susceptor 30 includes cover layer 32, adhesive layer 34, metalized layer 36, substrate 38, metalized layer 40, adhesive 42 and cover layer 44. In this preferred embodiment, cover layers 32 and 44 support and encase the remainder of the susceptor structure. Cover layers 32 and 44 are typically made of a polymer material or another type of support material such as paperboard or corrugated paper which is dimensionally stable through a temperature ranging up to several hundred degrees C. During cooking, food may be placed in contact with either cover layer 32 or cover layer 44 or both.

Metalized layer 36 is deposited on substrate 38 in the same way that metalized layer 14 is deposited on substrate 12 of susceptor 10 shown in FIG. 1A. Metalized substrate 38 is then bonded to cover layer 32 with adhesive 34. Adhesive 34 is typically a commercially available susceptor adhesive. Thus, cover layer 32, adhesive 34, metalized layer 36 and substrate 38 generally form a conventional susceptor structure such as susceptor 10 shown in FIG. IA.

However, in susceptor 30, another metalized layer 40 is deposited on a side of substrate 38 opposite metalized layer 36. Metalized layer 40 is bonded, with adhesive layer 42, to second cover layer 44.

In operation, cover layer 32, adhesive layer 34, metalized layer 36 and substrate 38 perform in a substantially similar way as conventional susceptor 10 and could thus be formed as any commercially available metalized film susceptor. Therefore, when exposed to microwave energy, metalized layer 36 absorbs a high amount of energy initially. Then, as substrate 38 begins to get hot, discontinuities develop in metalized layer 36 as described with reference to FIGS. 1A, 1B, 1C and ID. These discontinuities reduce the electrical continuity of metalized layer 36 and, eventually, the contribution to the heating of susceptor 30, by metalized layer 36 is reduced.

However, metalized layer 40 is bonded to cover layer 44 by adhesive layer 42. Adhesive layer 42 has qualities which cause metalized layer 40 to adhere more strongly to cover layer 44 than to substrate 38 when susceptor 30 is exposed to microwave energy. Thus, as substrate 38 gets hot, it does not cause discontinuities to develop in metalized layer 40. Rather, metalized layer 40 is held in place through strong adhesive layer 42, and as substrate 38 melts locally and moves, it effectively pulls away from metalized layer 40 leaving metalized layer 40 intact. Thus, metalized layer 40 maintains its electrical continuity throughout exposure to microwave energy. This allows continued absorption of microwave energy by metalized layer 40.

If metalized layer 40 were chosen improperly, continued absorption of microwave energy by metalized layer 40 would result in a condition known as runaway heating. In that case, the temperature reached in susceptor 30, when exposed to microwave energy, could reach temperatures sufficient to char or burn the paper or food product being surface heated by susceptor 30 in the microwave oven.

Therefore, metalized layer 40 is chosen with electrical and physical properties which yield, for example, 5 to 20 percent power absorption in free space when exposed to microwave energy. This provides for maintained heating of the food product by susceptor 30, without susceptor 30 experiencing runaway heating. Metalized layer 40 may be an elemental metal or an alloy whose impedance, when coated onto another layer, can be reliably controlled. Preferred materials are nickel, cobalt, titanium or chromium. Metalized layer 40 could also be either a coated or printed dielectric medium with similar levels of power absorption. However, an elemental metal is preferred if metalized layer 40 is deposited using vapor deposition so compositional changes during deposition are not a concern.

In essence, the overall operation of susceptor 30 is improved. Initially, metalized layer 36 absorbs a large amount of microwave energy that causes the temperature of susceptor 30 to rise rapidly. Then, metalized layer 36 begins to break up. Thus, the contribution to heating by metalized layer 36 is reduced. However, rather than cooling to a point where it is no longer capable of sufficient surface heating to brown or crisp the food surface, susceptor 30 achieves additional sustained heating through metalized layer 40. Although metalized layer 40 absorbs a lower percentage of microwave energy than metalized layer 36 initially did to avoid runaway heating, layer 40 absorbs a sufficient amount of microwave energy for susceptor 30 to achieve sustained heating thereby enhancing Adhesive layer 42 is prefer-ably a high temperature structural epoxy resin adhesive. In one embodiment, a high temperature epoxy resin adhesive was used which is available under the trademark SCOTCH-WELD 2214 sold by the 3M company of St. Paul, MN. Although some components of that particular adhesive are not presently FDA approved, any adhesive which is capable of preventing large impedance shifts in metal layer 40 by strong bonding of the metal layer 40 and which has FDA approval can be used with the present invention in cooking food.

As one example of susceptor 30, layers 36 and 38 are formed as a conventional susceptor, layer 40 is 40Å of Inconel 600 deposited by vapor deposition on PET substrate 38 yielding approximately 11% absorption in free space. Adhesive layer 42 is SCOTCHWELD 2214 adhesive, and layer 44 is 17 ½ point uncoated susceptor board.

Figure 3:
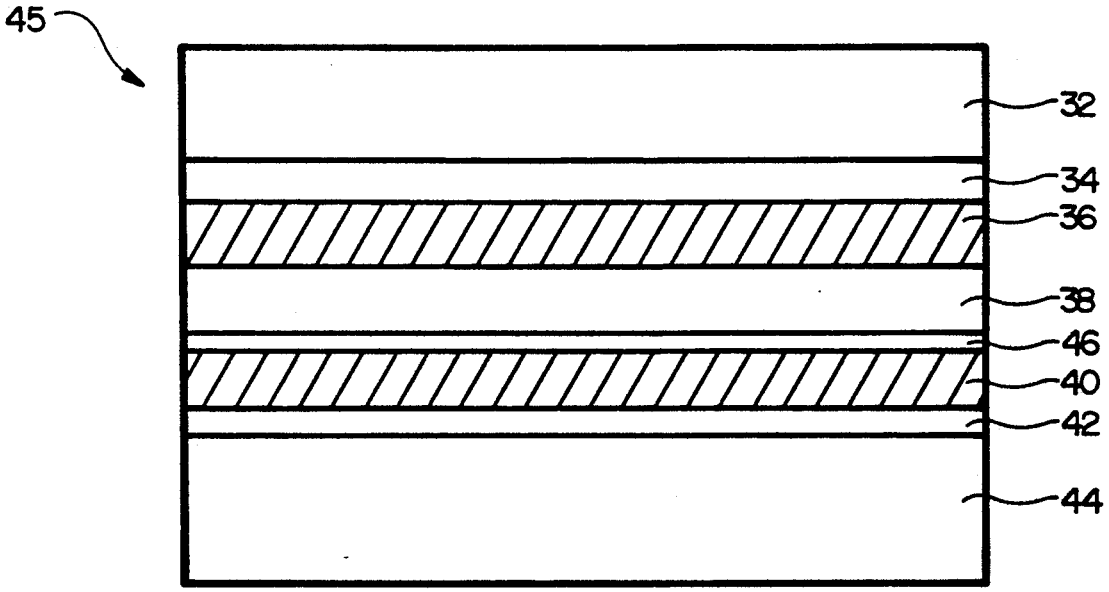
FIG. 3 is a second embodiment of a susceptor structure of the present invention.

FIG. 3 shows a second preferred embodiment of the present invention. Many of the layers shown in FIG. 3 are similar to those shown in FIG. 2 and are correspondingly numbered. However, in the preferred embodiment shown in FIG. 3, susceptor 45 also includes releasing layer 46 located adjacent substrate 38. In this preferred embodiment, layer 46 is a non-shrinking material which has a lower softening point than substrate 38.

In operation, susceptor 45 operates substantially the same as susceptor 30 with the exception of releasing layer 46. As susceptor 45 heats, releasing layer 46 softens before substrate 38 since it has a lower softening point than the onset of melting temperatures of substrate 38 as determined by scanning calorimetry.

Softened releasing layer 46, which is typically a molten polymer, thus forms a viscous layer between second metalized layer 40 and substrate 38 before substrate 38 drives formation of discontinuities in layer 40. This viscous layer allows substrate 38 to move and develop discontinuities locally relative to metalized layer 40, without substrate 38 exerting breakup force on metalized layer 40. Therefore, metalized layer 40 adheres more easily to adhesive layer 42 and substantially maintains its microwave absorptive quality (i.e. its electrical continuity) in the face of movement by layer 38.

In effect, releasing layer 46 preferrably rigidly couples layer 40 to substrate 38 at ambient temperature. However, when susceptor 45 heats in response to absorption of microwave energy, layer 46 softens and releases layer 40 from its rigid attachment to substrate 38 to allow relative movement of substrate 38 with respect to layer 40 so that layer 40 maintains its absorptive qualities even while substrate 38 causes breakup of layer 36. Releasing layer 46 can be any appropriate material having a softening point below substrate 38 and having minimal residual stresses that could cause layer 46 to shrink. Such materials could include polyethylene, or amorphous PET.

Figure 3A:
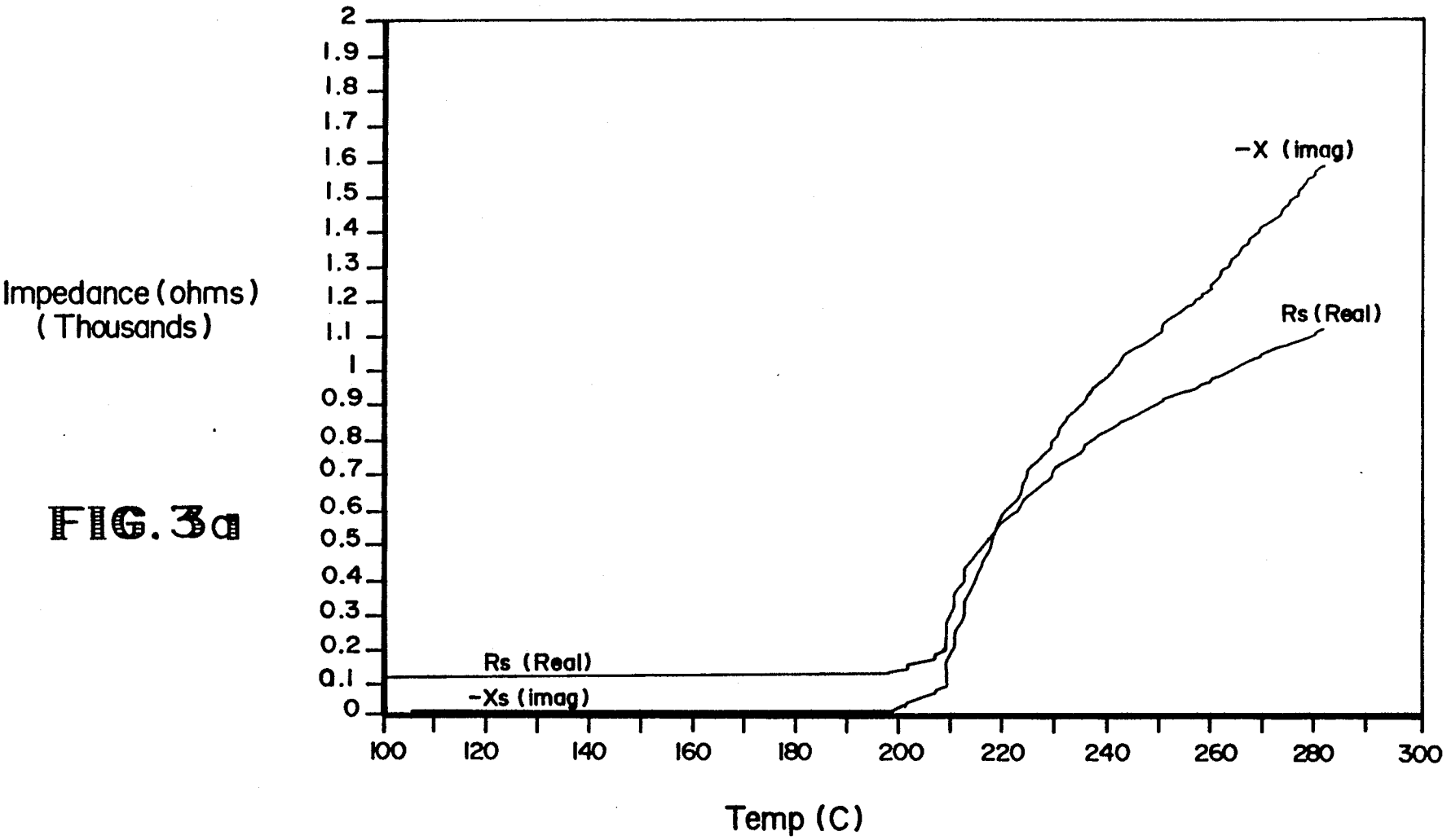
FIG. 3A is a graph showing surface impedance of a susceptor of the present invention plotted against degrees C.

FIG. 3A shows a graph of impedance (real $R_s$, and imaginary, $X_s$) of susceptor 45 plotted against temperature in degrees C. As shown, susceptor 45 continues heating beyond the susceptor of the prior art, yet layer 40 can be adjusted to prevent runaway heating.

As one example of susceptor 45, layer 36 is 278Å of Cr vapor deposited on layer 38 which is 48 gauge PET. Layer 46 is nominally a 2 gauge amorphous PET layer and layer 40 is 46Å Cr vapor deposited on layer 46 giving approximately 12% absorption in free space. Layers 34 and 42 are both layers of a commercially available susceptor adhesive, and layers 32 and 44 are commercially available susceptor board or other suitable materials.

FIG. 4 is a graph showing fraction power absorption, reflection, and transmission of incident microwave energy in free space by both layers 36 and 40. In this example, layer 36 is chosen with absorption, reflection, and transmission characteristics approximately corresponding to a range shown by dashed box 48, for example point A on the graph in FIG. 4. This may typically be a metal such as aluminum having a surface resistance of around 100Ω/sq. Layer 40 is chosen with absorption, reflection and transmission characteristics approximately corresponding to a range shown by dashed box 50, for example point B on the graph in FIG. 4. This will typically be a material having a surface resistance of around 2000Ω/sq. Thus, layer 36 initially absorbs between approximately 30 and 50 percent of the system power causing the susceptor to heat rapidly, and layer 40 absorbs approximately 5 to 20 percent. However, as the susceptor structure begins to heat, and as substrate 38 begins to drive formation of discontinuities in layer 36, the surface impedance of layer 36 increases. The power absorbed by layer 36 decreases and, on exposure to high electrical field strength, can approach zero.

The surface impedance of layer 40, however, does not change significantly under exposure to microwave energy. Therefore, layer 40 continues to absorb approximately the same percent of the power to which it is exposed. The net result is greater sustained heating in the susceptor structure without experiencing runaway heating temperatures which could char paper or burn food.

CONCLUSION

The susceptor structure of the present invention improves the heating performance of conventional susceptors when exposed to microwave energy. The susceptor structure initially heats up very quickly due to the high power absorption of layer 36, but layer 36 eventually breaks up to avoid runaway heating. Layer 40, which has essentially unchanging microwave absorption, remains intact during exposure to microwave energy thus providing sustained heating in the susceptor structure. The heating ability of layer 40 is determined by its impedance and is selected so as to prevent scorching or burning (typically 5–20% absorptive).

It should be noted that, with the susceptor structure of the present invention, the food product to be heated can be placed on either side of the susceptor structure (i.e. adjacent cover layer 32, or cover layer 44). Also, it should be noted that, since it is desirable to avoid having any of the susceptor components become part of the food product during cooking, cover layers 32 or 44 should have some type of coating which does not stick to the food product. Thus, layers 32 or 44 can be plastic, paper, a polymeric coating or any other suitable type of material that does not stick to food or has a release coating added.

It should also be noted that several structural options exist to accomplish the present invention. For example, layer 44 can be made of paper and the paper can be metalized with metal layer 40. Then, the metalized paper can be glued to substrate 38 or layer 46. Alternatively, layers 46 or 38 can be directly metalized with layer 40. In any case, by isolating the metalized layer 40 from the movement forces of substrate 38, metalized layer 40 stays intact throughout exposure to microwave energy. This allows sustained heating in the susceptor while avoiding runaway heating conditions.

Although the present invention has been described with reference to preferred embodiments, workers skilled in the art will recognize that changes may be made in form and detail without departing from the spirit and scope of the invention.

What is claimed is:

1. A susceptor structure, comprising:

a substrate having a first side and a second side;

a first microwave interactive layer on the first side of the substrate;

a second microwave interactive layer on the second side of the substrate, the first and second microwave interactive layers absorbing different levels of microwave energy during exposure of the susceptor structure to microwave energy; and a first covering layer coupled to the first microwave interactive layer, the first covering layer being substantially dimensionally stable relative to the substrate when exposed to microwave energy, and the first microwave interactive layer being more firmly coupled to the first covering layer than to the substrate during exposure of the susceptor structure to microwave energy.

2. The susceptor structure of claim 1 wherein the first microwave interactive layer comprises:

a heating layer having physical and electrical properties so that it absorbs a substantially constant amount of microwave energy when exposed to microwave energy.

3. The susceptor structure of claim 2 wherein the heating layer absorbs microwave energy in an amount not greater than approximately 20% of the microwave energy to which the heating layer is exposed.

4. The susceptor structure of claim 3 wherein the heating layer absorbs not more than 15% of the microwave energy to which the heating layer is exposed.

5. The susceptor structure of claim 3 wherein the heating layer absorbs not more than 10% of the microwave energy to which the heating layer is exposed.

6. The susceptor structure of claim 3 wherein the heating layer has physical and electrical properties so that it initially absorbs a lower percent of microwave energy than the second microwave interactive layer.

7. The susceptor structure of claim 6 wherein the heating layer is a first metal film.

8. The susceptor structure of claim 7 wherein the second microwave interactive layer is a second metal film.

9. The susceptor structure of claim 8 wherein the second metal film is aluminum.

10. The susceptor structure of claim 7 wherein the first metal film is Nickel.

11. The susceptor structure of claim 7 wherein the first metal film is Titanium.

12. The susceptor structure of claim 7 wherein the first metal film is Chromium.

13. The susceptor structure of claim 8 wherein the first metal film is an alloy.

14. The susceptor structure of claim 1 wherein the substrate is a polymer material.

15. The susceptor structure of claim 14 wherein the polymer material is polyethylene terephthalate.

16. The susceptor structure of claim 1 wherein the first covering layer comprises paper.

17. The susceptor structure of claim 1 wherein the first covering layer comprises paperboard.

18. The susceptor structure of claim 1 wherein the first covering layer comprises a polymer.

19. The susceptor structure of claim 1 and further comprising:

a second covering layer coupled to the second microwave interactive layer.

20. A susceptor structure for heating when exposed to microwave energy, the susceptor structure comprising:

a substrate having a first side and a second side;

a first microwave interactive layer on the first side of the substrate;

a releasing layer coupled between the substrate and the first microwave interactive layer, the releasing layer having physical and electrical properties chosen so the releasing layer releases the first microwave interactive layer from rigid attachment to the substrate when the susceptor structure is exposed to microwave energy;

a first cover layer coupled to the first microwave interactive layer; and a second microwave interactive layer coupled to the second side of the substrate.

21. The susceptor structure of claim 20 wherein the releasing layer rigidly couples the first microwave interactive layer to the substrate prior to exposure of the susceptor structure to microwave energy.

22. The susceptor structure of claim 21 wherein the releasing layer comprises:

a non-shrinking layer effectively releasing the first microwave interactive layer from being rigidly coupled to the substrate when the susceptor structure is exposed to microwave energy to facilitate relative movement of the substrate with respect to the first microwave interactive layer.

23. The susceptor structure of claim 22 wherein the substrate has a melting temperature, and wherein the non-shrinking layer comprises:

a polymer layer having a softening temperature lower than the melting temperature of the substrate.

24. The susceptor structure of claim 20 and further comprising:

a second cover layer coupled to the second microwave interactive layer.

25. The susceptor structure of claim 20 wherein the first microwave interactive layer comprises:

a heating layer having physical and electrical properties so that it initially absorbs a lower percent of microwave energy than the second microwave interactive layer.

26. The susceptor structure of claim 25 wherein the heating layer has physical and electrical properties so that it absorbs a substantially constant amount of microwave energy when exposed to microwave energy.

27. The susceptor structure of claim 26 wherein the heating layer absorbs no more than approximately 20% of the microwave energy to which the heating layer is exposed.

28. The susceptor structure of claim 20 wherein the second microwave interactive layer is a metal film having a surface resistance in a range of approximately 30Ω/sq to 250Ω/sq.

29. The susceptor structure of claim 28 wherein the metal film is aluminum.

30. The susceptor structure of claim 20 wherein the substrate is a polymer material.

31. The susceptor structure of claim 30 wherein the polymer material is polyethylene terephthalate.

32. The susceptor structure for heating when exposed to microwave energy, the susceptor structure comprising:

a substrate having a first side and a second side;

a releasing layer coupled to the first side of the substrate.

a first metal layer coupled to the releasing layer, the releasing layer located between the first metal layer and the substrate and accommodating movement of the substrate relative to the first metal layer when the susceptor structure is exposed to microwave energy; and a second metal layer coupled to the second side of the substrate.

33. The susceptor structure of claim 32 wherein the releasing layer rigidly couples the first metal layer to the substrate prior to exposure of the susceptor structure to microwave energy.

34. The susceptor structure of claim 33 wherein the releasing layer releases the first metal layer from being rigidly coupled to the substrate when the susceptor structure is exposed to microwave energy to facilitate relative movement of the substrate with respect to the first metal layer.

35. The susceptor structure of claim 34 wherein the releasing layer comprises:

a non-shrinking layer having a softening temperature lower than the onset of melting temperature of the substrate.

36. The susceptor structure of claim 35 wherein the non-shrinking layer is low density polyethylene.

37. The susceptor structure of claim 35 wherein the non-shrinking layer is amorphous polyethylene terephthalate.

38. The susceptor structure of claim 32 wherein the first metal layer has physical and electrical properties so that it initially absorbs a lower percent of microwave energy than the second metal layer.

39. The susceptor structure of claim 38 wherein the first metal layer comprises:

a heating layer having physical and electrical properties so that it absorbs a substantially constant amount of microwave energy when exposed to microwave energy.

40. A susceptor structure, comprising:

a substrate having a first side and a second side;

a first metal layer on the first side of the substrate;

a second metal layer on the second side of the substrate; and a cover layer coupled to the first metal layer so that the first metal layer is more firmly coupled to the cover layer than tot he substrate during exposure of the susceptor structure to microwave energy, the cover layer being substantially dimensionally stable relative to the substrate when exposed to microwave energy.

41. The susceptor structure of claim 40 and further comprising:

a releasing layer coupled between the first metal layer and the substrate, the releasing layer releasing the first metal layer from the substrate when the susceptor structure is exposed to microwave energy.

42. The susceptor structure of claim 41 wherein the releasing layer rigidly couples the first metal layer to the substrate prior to exposure of the susceptor structure to microwave energy.

43. The susceptor structure of claim 42 wherein the releasing layer comprises:

a non-shrinking layer effectively releasing the first metal layer from being rigidly coupled to the substrate when the susceptor structure is exposed to microwave energy to facilitate relative movement of the substrate with respect to the first metal layer.

44. The susceptor structure of claim 43 wherein the substrate has an onset of melting temperature, and wherein the non-shrinking layer comprises:

a polymer layer having a softening temperature lower than the onset of melting temperature of the substrate.

45. The susceptor structure of claim 44 and further comprising:

a second cover layer coupled to the second metal layer.

46. The susceptor structure of claim 44 wherein the heating layer has physical and electrical properties so that it absorbs a substantially constant amount not greater than 20% of the microwave energy to which the heating layer is exposed.

47. The susceptor structure of claim 41 wherein the first metal layer comprises:

a heating layer having physical and electrical properties so that it initially absorbs a lower percent of microwave energy than the second metal layer.

48. A susceptor structure, comprising:

a substrate;

a first metal layer coupled to a first side of the substrate;

a second metal layer coupled to a second side of the substrate wherein the first metal layer initially absorbs microwave energy at a lower level than the second metal layer; and a cover layer substantially dimensionally stable relative to the substrate, coupled to the first metal layer, the first metal layer being more firmly coupled to the cover layer than to the substrate during exposure of the susceptor structure to microwave energy.

49. The susceptor structure of claim 48 and further comprising:

a releasing layer coupled between the first metal layer and the substrate the releasing layer releasing the first metal layer from the substrate to facilitate relative movement of the substrate with respect to the first metal layer when the susceptor structure is exposed to microwave energy.

50. The susceptor structure of claim 49 wherein the releasing layer comprises:

a non-shrinking polymer layer having a softening temperature lower than a melting temperature of the substrate.

51. A susceptor structure, comprising:

a first heating layer formed to heat upon exposure to microwave energy; and a second heating layer formed to heat upon exposure to microwave energy until the second heating layer reaches a threshold temperature level, and wherein the first heating layer is coupled to the second heating layer so the second heating layer substantially reduces heating upon reaching the threshold temperature level, and so the first heating layer continues heating after the second heating layer substantially reduces heating.

52. The susceptor of claim 51 wherein the first and second heating layers are formed to heat as a function of electrical current flowing in the first and second heating layers as a result of exposure to microwave energy.

53. The susceptor of claim 52 wherein the second heating layer is formed to develop electrical discontinuities upon reaching the threshold temperature level, thereby reducing the amount of electrical current flowing in the second heating layer upon reaching the threshold temperature level.

* * * * *

UNITED STATES PATENT AND TRADEMARK OFFICE

CERTIFICATE OF CORRECTION

PATENT NO. : 5,170,025

DATED : December 8, 1992

INVENTOR(S) : MICHAEL R. PERRY

It is certified that error appears in the above-identified patent and that said Letters Patent is hereby corrected as shown below:

On the title page, in the References Cited Section, under 35 U.S. PATENT DOCUMENTS, insert the following:

4,985,300 1/1991 Huang.....426/392

Col. 8, line 12, delete "claim 8", insert "claim 7"

Col. 9, line 23, delete "The", insert "A"

Col. 10, line 6, delete "tot he", insert "to the"

Col. 10, line 65, after "substrate", insert a ","

Signed and Sealed this

Twenty-third Day of November, 1993

*Attest:*

Bruce Lehman

BRUCE LEHMAN

*Attesting Officer*

*Commissioner of Patents and Trademarks*